US010221039B2

(12) United States Patent
Hettema et al.

(10) Patent No.: US 10,221,039 B2
(45) Date of Patent: Mar. 5, 2019

(54) TRANSFORMATIVE ELEVATOR DISPLAY SYSTEM

(71) Applicant: LEGENDS ATTRACTIONS, LLC, New York, NY (US)

(72) Inventors: Philip Hettema, Los Angeles, CA (US); Susan Spence, Altadena, CA (US); Arthur Derby Ahlstone, Ventura, CA (US); Benjamin Lien, Los Angeles, CA (US)

(73) Assignee: Legends Attractions, LLC, New York, NY (US)

( * ) Notice: Subject to any disclaimer, the term of this patent is extended or adjusted under 35 U.S.C. 154(b) by 0 days.

(21) Appl. No.: 15/168,820

(22) Filed: May 31, 2016

(65) Prior Publication Data

US 2017/0113899 A1 Apr. 27, 2017

Related U.S. Application Data

(60) Provisional application No. 62/168,121, filed on May 29, 2015.

(51) Int. Cl.

| | |
|---|---|
| ***B66B 11/02*** | (2006.01) |
| ***B66B 3/00*** | (2006.01) |
| ***B66B 3/02*** | (2006.01) |
| ***B66B 9/00*** | (2006.01) |

(52) U.S. Cl.

CPC ..... *B66B 3/008* (2013.01); *B66B 3/02* (2013.01); *B66B 9/00* (2013.01); *B66B 11/0226* (2013.01)

(58) Field of Classification Search

CPC ..... B66B 3/008; B66B 9/00; B66B 11/0226
USPC ..... 187/401
See application file for complete search history.

(56) References Cited

U.S. PATENT DOCUMENTS

| | | | | |
|---|---|---|---|---|
| 5,004,225 | A | 4/1991 | Krukovsky | |
| 6,578,675 | B2 | 6/2003 | Wilson et al. | |
| 2005/0087403 | A1* | 4/2005 | Mehr | B66B 11/0226 187/396 |
| 2006/0065492 | A1 | 3/2006 | Trifu | |
| 2012/0256945 | A1* | 10/2012 | Kidron | A63G 31/16 345/619 |

OTHER PUBLICATIONS

The International Searching Authority, Notification of Transmittal of the International Search Report, US Patent and Trademark Office, Application No. PCT/US2016/035009, dated Aug. 29, 2016.
The International Searching Authority, Written Opinion of the International Searching Authority, US Patent and Trademark Office, Application No. PCT/US2016/035009, dated Aug. 29, 2016.

(Continued)

*Primary Examiner* — Jeffrey Donels
(74) *Attorney, Agent, or Firm* — Gottlieb, Rackman & Reisman, P.C.

(57) ABSTRACT

The invention is generally directed to an elevator display system which provides the illusion of observing a visual narrative of an elevator trip which is made to appear as if the actual elevator has glass walls and one is observing a fanciful elevator trip. The elevator can have a variety of different fanciful rides which are not restricted by the constraints of time, location or physics.

13 Claims, 5 Drawing Sheets

(56) References Cited

OTHER PUBLICATIONS

LG UK. So Real It's Scary. Retrieved from the Internet URL: https://www.youtube.com/watch?v=NeXMxuNNIE8>, Video Online—(You Tube), pp. 1-2, Aug. 5, 2016.
Funniest Videos TV. Fast Elevator Prank Beautiful Russian Girl. Retrieved from the Internet URL: https://www.youtube.com/watch?v=ox7fibWSJY>, Video Online—(You Tube), p. 1, Aug. 5, 2016.
Take a tour of new One World Observatory, Retrieved from the Internet URL: https://www.youtube.com/watch?v=aDIN26yxbnw, Video Online—(You Tube) pp. 1-3, May 20, 2015.

* cited by examiner

TRANSFORMATIVE ELEVATOR DISPLAY SYSTEM

This application claims the priority of U.S. Provisional Patent Application Ser. No. 62/168,121, filed on May 29, 2015.

BACKGROUND OF THE INVENTION

The invention is generally directed to an elevator display system which provides the illusion of observing a visual narrative of an elevator trip which is made to appear as if the actual elevator has glass walls and one is observing a fanciful elevator trip.

Elevator technology has improved considerably over time so that safe vertical transport between the ground floor and different floors in buildings and other structures can be achieved safely and more rapidly than in the past. However, there are taller buildings which have extended periods of time still necessary to transport from the ground floor to one of the upper floors. In many situations the time involved in transporting is of such scope that it provides an uncomfortable and tension filled trip. Current elevators have been designed and upgraded to include small display panels which are capable of displaying static information regarding the weather, stock market prices and similar small bits of data to distract the elevator riders from the boredom of spending time in an elevator. However, in certain new and particularly tall buildings, there are generally long express elevators transporting riders up a large number of floors, including more than 100 floors at a single run which create lengthy periods of time for riders in the elevators. In particular, for high altitude observatories at the tops of particularly tall buildings the elevators have single runs which can extend even beyond one minute. Particularly, where the elevators are a component of an observatory or other attraction, the developers of such attractions seek to enhance the visitor's experience without gaps. Accordingly, there is a need to provide improved elevator displays for long haul vertical ascending and descending environments.

There is also a desired need for an elevator to function as a teaching component related to the attraction to which it is a people mover so that the time spent in the elevator on the way up provides an introduction to the attraction and the ride down provides a coda to the attraction as the visitors are leaving.

SUMMARY OF THE INVENTION

The invention is generally directed to an enhanced elevator cab display system which provides display elements on the three non-door walls of an elevator cab which offer enhanced displays projected on the display panels which create the effect of looking out of a glass walled elevator cab and which provide journeys which are thematically linked to the location of the elevator and an attraction or theme which enhances the elevator rider's ascension or descension in the elevator, as well as distracting them from the length of the elevator trip.

Another object of the invention is to provide an enhanced elevator display system which creates a fanciful voyage display as the elevator makes its vertical ascent or descent.

Yet still a further object of the invention is to provide an enhanced elevator ride display which converts a standard elevator cab into an apparently glass walled elevator cab with a display as the elevator ascends and descends which can recreate trips through real or imaginary elevator trips.

Still yet another object of the invention is to provide an ability to create a series of different elevator experiences so that each entry into an elevator provides a different voyage, even though the elevator never leaves its shaft.

A further object of the invention is to provide a way to educate and entertain elevator riders through an audio visual experience taking the riders on fanciful trips as the elevator rises or descends.

Still another object of the invention is to provide a means for passing large volumes of data and greater than usual power requirements of an elevator with three full wall displays through a traveler cable which has been enhanced to increase its ability to provide much greater power and data throughput than existing traveler cables.

Still other objects and advantages of the invention will, in part, be obvious and will, in part, be apparent from the specification.

The invention accordingly comprises the features of construction, combinations of elements and arrangements of part and processes which will be exemplified in the constructions and processes as hereinafter set forth, and the scope of the invention will be indicated in the claims.

BRIEF DESCRIPTION OF THE DRAWINGS

The present invention will now be described in more complete detail with frequent reference being made to the figures identified below.

DETAILED DESCRIPTION OF THE PREFERRED EMBODIMENTS

Figure 1:
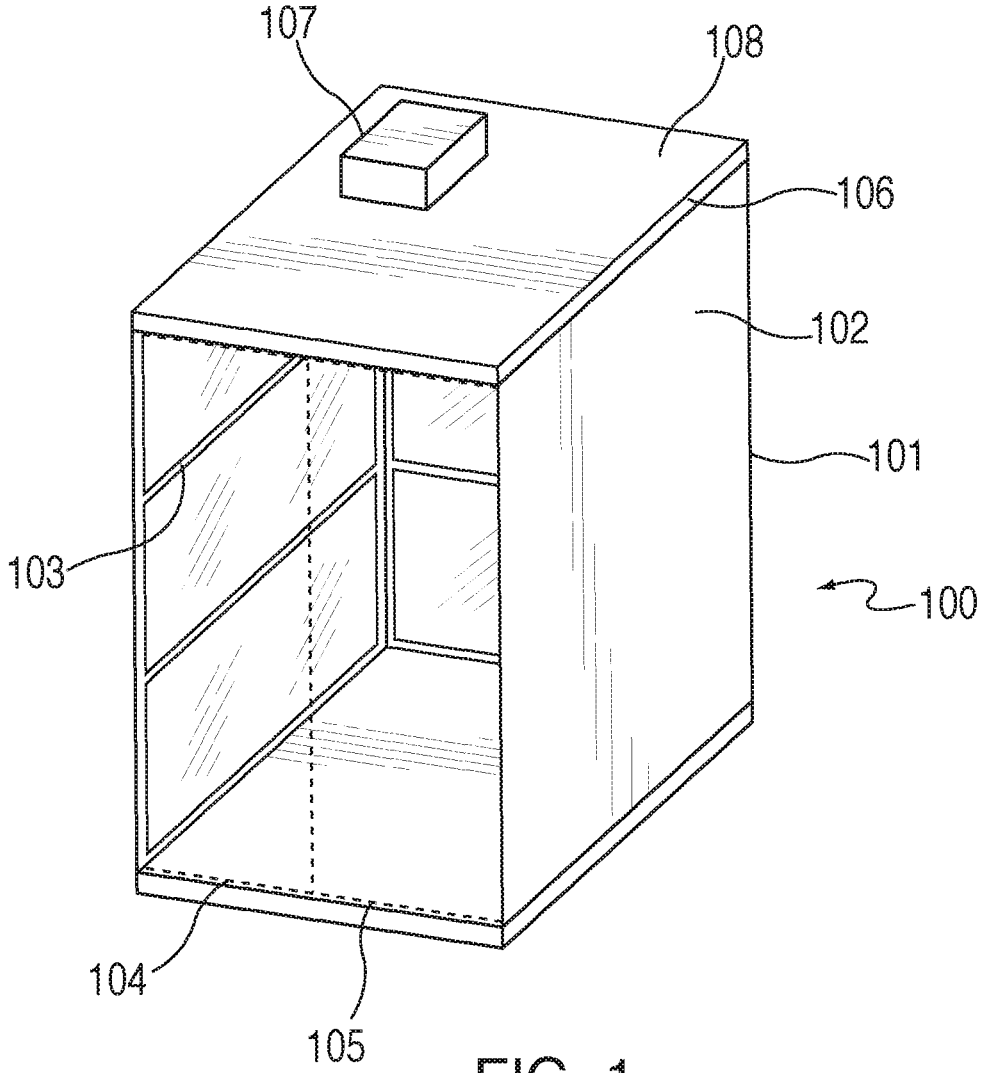
FIG. 1 is a perspective view of an elevator cab with displays constructed in accordance with a preferred embodiment of the invention.

The enhanced elevator display system in accordance with the invention is intended to take riders of the elevator 100 on fanciful and interesting voyages while riding in a standard elevator cab. The elevator as shown in FIG. 1 is a standard elevator cab assembly with the mechanical elements of the elevator consistent with existing technology for hoisting and lowering the elevator cab within an elevator shaft in a fixed structure from a ground floor level up through various levels to a top level. These common elements are not shown so as not to confuse the elements relevant to this system. The elevator cab has standard opening doors 104, 105, shown in dotted lines, which slide outwardly to provide an elevator opening in one of the four vertical walls of the cab. The remaining three vertical walls of the cab 101, 102, 103 are covered with panel monitors arranged so they create the illusion when operated that one is looking out of glass windows of the cab (201, 202, 203 in FIG. 2). The images displayed on the monitors create the illusion that one is looking through the walls of the cab to events which are taking place outside the elevator cab. Much in the way that the Willy Wonka and the Chocolate Factory elevator seems to leave the building as it ascends, the elevator display system in accordance with the invention provides a similar freedom from the constraints of physics, time and location such that the elevator can show the passage of time outside of a building or structure, the transformative effects of moving the elevator cab outside of the shaft in space, or other physically improbable or impossible events while the elevator ascends or descends.

Figure 2:
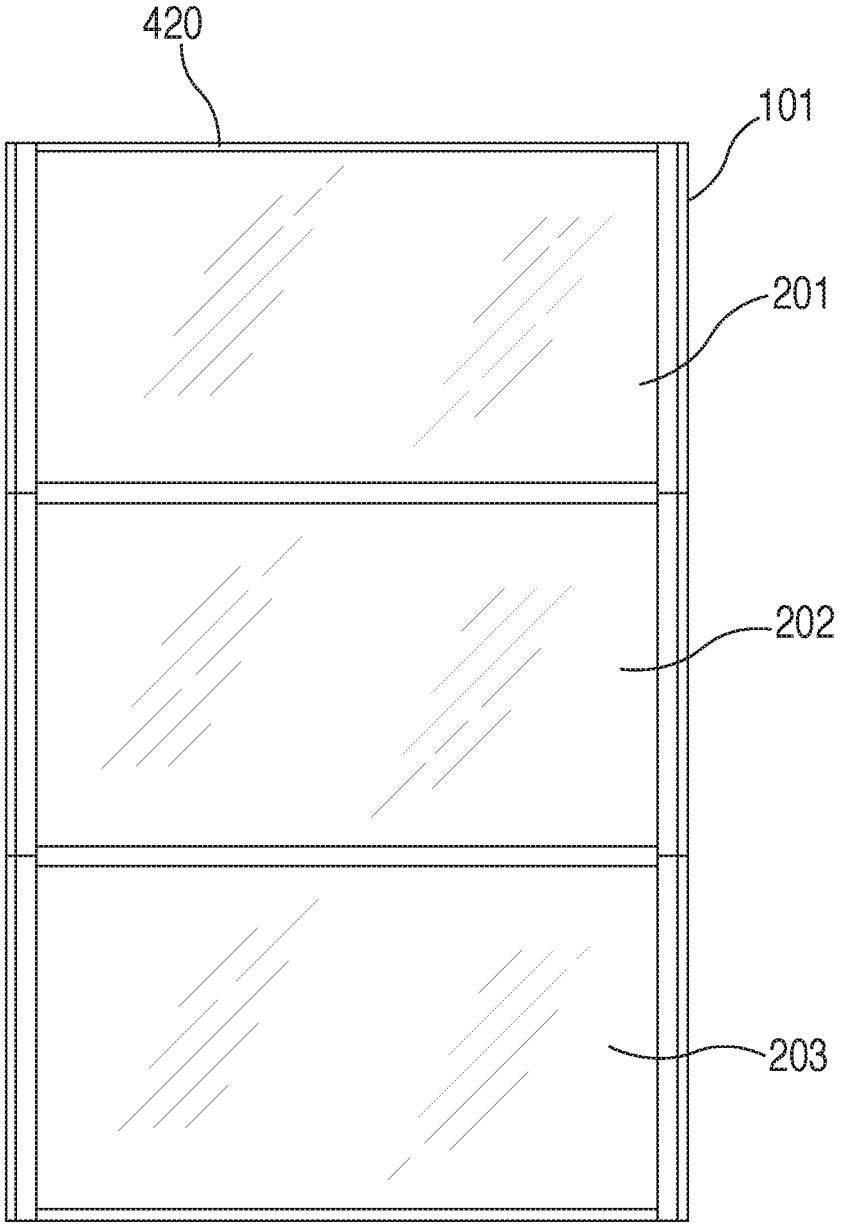
FIG. 2 is a front elevational view of an inside panel of the elevator cab of FIG. 1.
Figure 4:
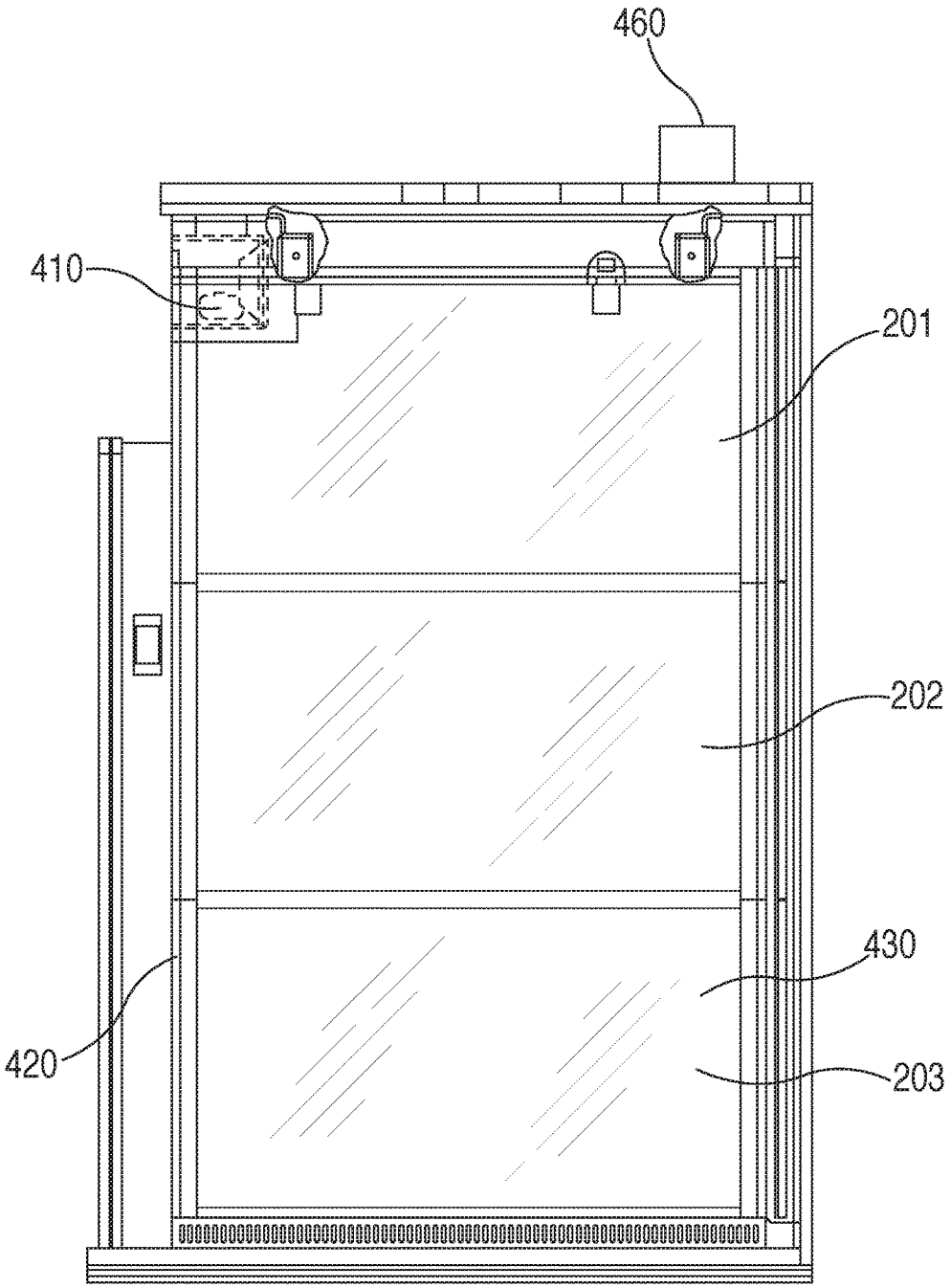
FIG. 4 is a front elevational view of one of the walls of the elevator cab of FIG. 1 with displays.

As shown in FIG. 2 the displays on each of the vertical walls on the elevator cab are formed of three separate monitors 201, 202, 203 stacked vertically so as to provide a full wall display element and are supported in a frame 420. In a current preferred embodiment of the invention each wall of the elevator cab with displays includes three Samsung high definition display monitors arranged one on top of another so a picture displayed on all three will appear like it is viewed through a window with two mullions separating the full panel display into three pieces separated by black lines at the edges of the adjoining top and middle monitors and at the horizontal edge separating the middle and bottom monitors. The frame 420 supports the monitors and forms the mullions between the displays. In a current preferred embodiment the frame is formed of a blackened stainless steel so that it looks more like a normal window. A thin transparent layer 430 is applied over the actual display monitors to prevent damage or dirt or oil being applied directly to the monitors' outer surface. This thin transparent layer 430 acts as a barrier and is more easily cleaned than would the separate monitor screens. In a preferred embodiment, as shown in FIG. 4, the transparent layer 430 is a 9/16" nonreflective laminated glass layer. The protective layer 430 may be any appropriate nonreflective transparent material which has sufficient strength and resistance to cracking, darkening or impact issues.

Figure 3:
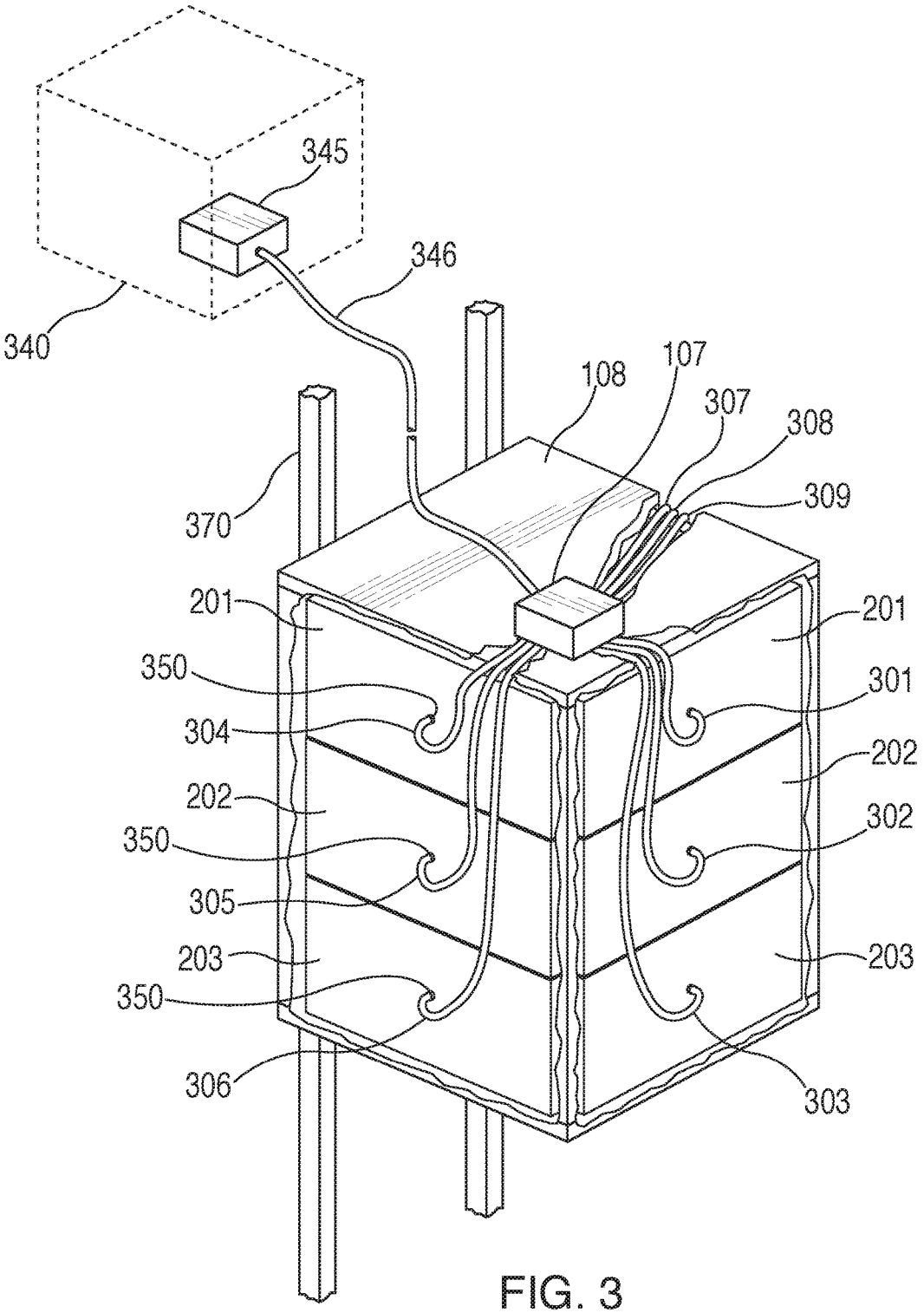
FIG. 3 is a perspective view of the outside view of the elevator cab of FIG. 1 showing data connections to the display elements.

The displays on the elevator cab walls are run by a computer system 107 which is preferably located on the top of the cab, out of view of the riders as shown in FIG. 3. The computer is connected to the data input connectors 350 of each of the nine display monitors 201, 202, 203. Power to the display monitors is provided from the traveler cable 346 for the elevator which provides all of the power and data connections with the building and the equipment room 340 for the elevator 100 which rides in shaft 370. In addition, backup and updated information related to the content used to display the images on the monitors is also stored on a separate computer 345, preferably located in the elevator mechanical room where mechanical equipment used to operate and control the elevator cab is located. This secondary computer 345 is used when the operators wish to change, update or replace the display show which is generally stored locally in the computer 107 which is situated on top of the elevator cab. Information loaded onto the secondary or remote computer 345 can be transferred to the local computer 107 riding on top of the elevator cab when the elevator cab is out of service and connected either directly or wirelessly to the secondary computer 345.

In a current preferred embodiment of the invention, which has been installed in a high altitude observatory at the top of a tall building, the displays are operated to provide separate and distinct elevator ride experiences on the ascent and descent of the visitor's experience in the observatory. The ascending ride, to introduce visitors to the area that the building is located in, includes a time based voyage, starting several hundred years in the past to see how the area around the building had developed over time. Essentially this is a voyage in time done visually on the walls of the elevator cab. The descending ride can include a visual fly around, with the elevator cab seeming to fly out of the shaft and building to circle the building and surrounding areas. Obviously, the rules of physics and safety would prohibit such a ride in reality. However, such a ride can be simulated and give a realistic look to the riders of the elevator without the physical problems or even nausea inducing movement of the actual elevator. In different circumstances there could be a rotating collection of different elevator voyages which might be displayed for different situations, such as in an express elevator in a tall office building taking visitors who daily ride the elevator with a wide variety of different fanciful voyages so as to provide continued interest during the lengthy ride to the express level which may be an intermediate ride prior to the ride in a more local elevator to the actual floor of their destination. The displays for the rides in the elevator can be developed for a wide variety of purposes, either educating, entertaining or even providing a thrill ride. They can also form a travelogue, taking riders on trips around foreign destinations or remote time periods. The monitors 201, 202, 203 can have speakers built in and, if desired, speaker or subwoofer 410 can be installed in the elevator to provide sound for narration to displays 201, 202, 203 as shown in FIG. 4. Also blowers 460 cool the displays. While only a single blower 460 is shown, in practice there should be sufficient blowers to keep the monitors sufficiently cooled.

The volume of data required to power the nine high definition monitors 201, 202, 203 on the three panels 101, 102, 103 of the elevator cab utilized to create the illusion of looking out of a glass walled elevator cab is so significant as to require highly specialized computer storage and processing power which requires the data to be stored locally within the cab and not externally in the elevator mechanical room. As a result, a computer 107 is associated with each elevator cab to store the "ride" for display on the display monitors 201, 202, 203 during the ride.

The amount of electrical power necessary to operate all of the systems for the elevator cab usually required in a normal elevator is inadequate to power the nine display monitors 201, 202, 203 as well as the ventilation and cooling fans required to operate the display monitors in the closed environment of an elevator shaft. As such, a specialized traveler cable 346, which feeds the electrical power and, where possible the data, needed to be developed to allow the display monitors to all function in the elevator cab environment. Prior traveler cables were designed to operate the hoisting functions, limited ventilation needs, interior lighting and perhaps a small data panel to provide travelers with some limited information such as temperature, stock market index prices or interesting news bits. However, existing traveler cables were inadequate to provide the elevator cab's basic power and data requirements when the severe additional loads of the three full wall displays and corresponding cooling and ventilation needs were added to this. Applicant developed new forms of traveler cables which included substantially enhanced power transmittal capabilities and significant data throughput to allow the data for a new or edited "ride" to be ported from the secondary computer 345 to the elevator cab based computer. In a current preferred embodiment of the invention, the traveler cable used is a Datwyler dynofil elevator travelling cable intended for high rise elevator applications. The travelling cable is relatively wide and has eight different clusters of conductors within its outer cover which are used for transmitting either power or data. Two of the clusters of conductors are preferably used to power the display panels in the elevator cab. Using two traveler cables 40 Amps at 240V are transmitted to the elevator cab to run the elevator display elements, which allows for sufficient voltage and current to operate the nine high definition monitors in addition to the electrical requirements in the elevator cab. The data requirements to run the displays in the elevator cab are met through a series of optical fibers in the traveler cables.

Figure 5:
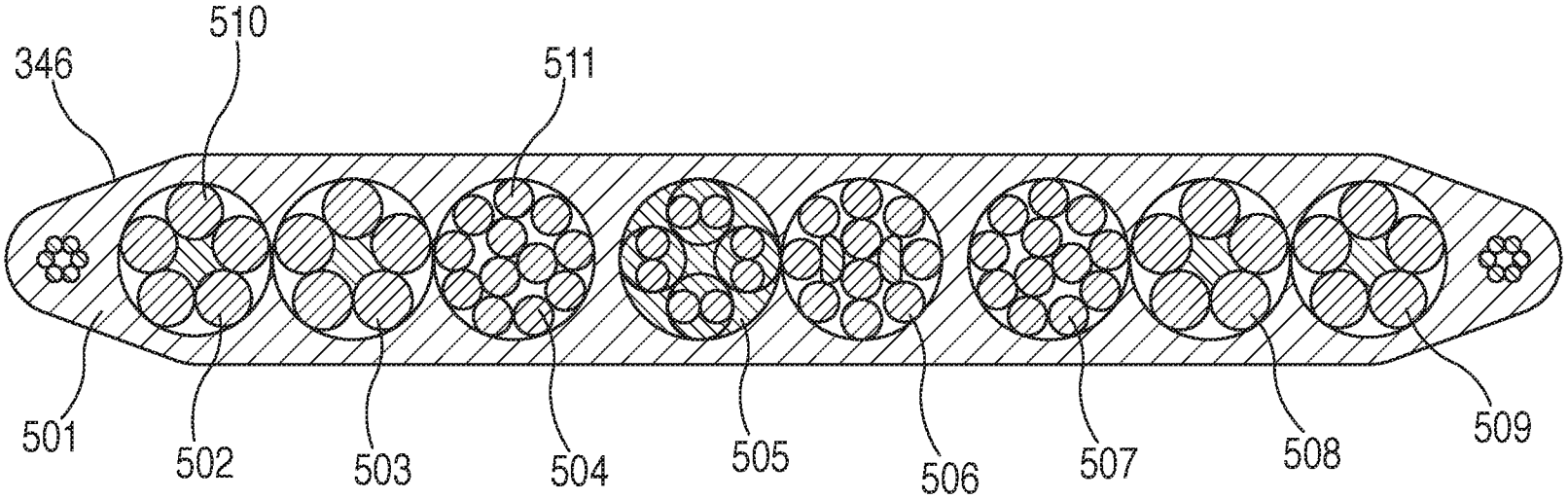
FIG. 5 is a cross-sectional view of a traveler cable in accordance with a preferred embodiment of the invention.

Reference is next made to FIG. 5 wherein the traveler cable 346 is shown. As can be seen in FIG. 5 the traveler cable is much wider than it is high and includes eight clusters of conductors 502-509 protected inside insulating and protective layer 501. In practice, the traveler cable 346 is intended to travel within the shaft secured to the elevator cab 100 so as to provide continuous power and data connections from the mechanical equipment room to the elevator cab wherever it is in the shaft. The traveler cable 346 has two basic types of connectors, the power connectors, shown here as 502, 503, 508 and 509, which are generally copper wires in 510 arranged in the clusters of five separate conductors 510, each of which is insulated from the adjoining conductor 510 and on the outside from the other clusters by insulated material 501. The second type of conductors are optical fiber conductors for carrying data 511, which are tightly grouped and similarly are insulated with optical fibers on the inside which is quite small and has an indicated optimal wave length and includes a strain relief element yarn to prevent damage from lengthwise stresses on the cable and has an outer sheath which is formed of a low fire hazard compound which protects the cable components from fire hazards. Finally, it has an outer sheath in accordance with standard arrangements for protection of optical fiber data conductors. As can be seen in FIG. 5, the optical fibers 511 in the conductor cluster 504 are tightly arranged to provide maximum data throughput in a small area. The data throughput is required when data is sent through the traveler cable 346 to the local computer 107 or from the remote computer 345 to the local computer 107 through the traveler cable 346.

In a current preferred embodiment the conductors are flexible bare copper strands of a Class 5 according to IEC/EN 60228, the insulation is PVC and the pairs of conductors have a 0.75 millimeter square area. The optical fibers 511 are multimode fibers supported by steel ropes with a PVC outer sheath. In the current preferred embodiment of the traveling cable 346, the maximum free suspension length is 250 meters.

As shown in FIG. 4, the cab 100 includes a stainless steel frame 420 which supports and protects displays 201, 202, 203. Frame 420 also covers the space between displays and act as mullions.

While in a current preferred embodiment of the invention there are displays on the three vertical walls of the elevator cab not including the door, the display could, in another preferred embodiment, cover the door wall of the elevator cab or the door wall and the floor and ceiling walls. When all four vertical walls are made part of a display there is an illusion that you are in a glass elevator cab. When the floor and ceiling walls are also covered with displays the glass cab can be seen to fly anywhere, with the riders fully surrounded by what appears to be the sights outside the cab. When the floor is covered with a display the transparent protective layer has to handle the weight and potential scratching effect of the passengers and their footwear.

It will thus be seen that the objects set forth above, among those made apparent in the preceding description, are efficiently obtained, and, since certain changes may be made in the above construction without departing from the spirit and scope of the invention, it is intended that all matter contained in the above description or shown in the accompanying drawings shall be interpreted as illustrative, and not in a limiting sense.

It is also understood that the following claims are intended to cover all of the generic and specific features of the invention herein described and all statements of the scope of the invention, which, as a matter of language, might be said to fall therebetween.

What is claimed is:

1. An improved elevator assembly comprising:

an elevator cab with hoist mechanisms, having four side walls, a ceiling wall and a floor wall, one of the four side walls being a door wall having an opening door to allow entry and egress of passengers;

a local computer, coupled to the elevator cab, for storing data to display at least one elevator ride display graphics;

a plurality of display panels, each of which covers a different one of the walls of the elevator cab;

each display panel including at least one display monitor electrically coupled to the local computer;

the local computer displaying a visual show on the plurality of display panels which creates the illusion of a ride in a glass elevator cab from the stored data;

a remote computer which can be coupled to the local computer for updating the data stored on the local computer and which is located in an equipment room holding mechanical equipment for the elevator system, and wherein the remote computer is connected to the local computer by a short distance connection when the elevator is at the position in its shaft closest to the equipment room.

2. The improved elevator assembly of claim 1 wherein each display panel includes three display monitors.

3. The improved elevator assembly of claim 1 further including a frame which supports the display monitors in the display panel.

4. The improved elevator assembly of claim 1 wherein there are three display panels, each of which covers a different one of three of the four side walls of the elevator cab not including the door wall.

5. The improved elevator assembly of claim 1 wherein there are four display panels each of which covers a different one of the four side walls of the elevator cab including the door wall.

6. The improved elevator assembly of claim 5 wherein there are display panels on the ceiling wall and floor wall.

7. The improved elevator assembly of claim 1 wherein the remote computer is connected to the local computer by a traveler cable which provides power and data to the elevator cab, display panels and local computer.

8. The improved elevator assembly of claim 7 wherein the traveler cable is formed with a series of separate connectors, some of which convey electrical power and the others convey data.

9. The improved elevator assembly of claim 1 wherein the short distance connection is a wireless connection or a wired connection.

10. The improved elevator assembly of claim 1 wherein the display graphics are displayed to provide the illusion of viewing the exterior of the cab through a glass walled elevator cab.

11. The improved elevator assembly of claim 1 wherein the local computer stores enough data to display at least two separate rides and is configured to display on the panels a first ride on the ascent of the elevator and a second ride separate and distinct from the first ride on a descent of the elevator.

12. The improved elevator assembly of claim 1, wherein the local computer is mounted exterior to and on the top of the elevator cab.

13. The improved elevator assembly of claim 5, wherein the local computer is configured to create the illusion of a ride in a glass elevator cab from the stored data by producing a contiguous view of a common scene for display across each of the plurality of display panels.

* * * * *